United States Patent [19]

Groenendaal, Jr. et al.

[11] Patent Number: 4,661,043

[45] Date of Patent: Apr. 28, 1987

[54] STEAM TURBINE HIGH PRESSURE VENT AND SEAL SYSTEM

[75] Inventors: John C. Groenendaal, Jr.; Boyd Brown, both of Winter Springs, Fla.

[73] Assignee: Westinghouse Electric Corp., Pittsburgh, Pa.

[21] Appl. No.: 790,679

[22] Filed: Oct. 23, 1985

[51] Int. Cl.[4] ..... F01D 3/00

[52] U.S. Cl. ..... 415/104; 415/105

[58] Field of Search ..... 415/104, 106, 107, 108, 415/168, 105, 96

[56] References Cited

U.S. PATENT DOCUMENTS

| | | | |
|---|---|---|---|
| 2,467,818 | 4/1949 | Elston | 415/107 |
| 2,796,231 | 6/1957 | Hertl | 415/108 |
| 2,888,240 | 5/1959 | Fleischmann | 415/108 |
| 2,920,867 | 1/1960 | Reese et al. | 415/96 |
| 3,614,255 | 10/1971 | Rooney | 415/107 |
| 3,746,463 | 7/1973 | Stock et al. | 415/108 |
| 4,362,464 | 12/1982 | Stock | 415/108 |

*Primary Examiner*—Robert E. Garrett
*Assistant Examiner*—John Kwon
*Attorney, Agent, or Firm*—F. J. Baehr, Jr.

[57] ABSTRACT

A steam turbine having a chamber in the inlet end thereof adjacent the thrust balance piston and dummy ring formed so that the temperature is substantially reduced while the pressure is only slightly reduced to optimize the pressure temperature affect on the balance piston and rotor utilizing labyrinth seals and a static seal together with vent ports in fluid communication with the chamber and an area downstream of the first row of rotatable blades to provide a more efficient and reliable turbine.

4 Claims, 2 Drawing Figures

STEAM TURBINE HIGH PRESSURE VENT AND SEAL SYSTEM

BACKGROUND OF THE INVENTION

This invention relates to steam turbines and more particularly to a system for sealing and venting the high pressure end thereof.

For efficiency reasons the United States utility industry requires multivalve variable inlet nozzles steam flow area control for turbine generators. As a result individual valves provide steam flow to individual inlet nozzle chambers and their associated nozzle vanes. Inlet nozzle vanes and the first rotating blade row are combined to form a control stage. Nozzle exit steam in the axial space between the nozzle vanes and the rotating blades can flow along a leakage path between nozzle seal strips and the rotor at both the base of the nozzle and the outer diameter of the blade shroud. The quantity of leakage has an effect on efficiency since no work has been done by this steam that has bypassed the rotating blade row. This leakage temperature for conventional fossile turbo generators is in the vicinity of 970° F. at rated power and decreases with load. Even at half rated load, this leakage steam temperature is above 900° F.

In high pressure turbines this high temperature nozzle exit leakage steam can flow between the rotor and the nozzle chamber assembly to the rotor thrust dummy balance piston. For a given geometry, the rotor material strength, with respect to maximum creep tangential stress, decreases with increasing temperature. Therefore, it is desirable to reduce this leakage temperature. One method of reducing the steam temperature the rotor is exposed to is shown in U.S. Pat. No. 3,206,166. In this patent the control stage flow direction is opposed to the direction of the following row of high pressure turbine blades and a venting and sealing system isolates the nozzle exit leakage steam from direct contact with the rotor. Single flow high pressure turbines and combined high pressure intermediate pressure turbines require a rotor thrust balancing dummy piston that has a diameter approximately equivalent to the average mean diameter of the blade path. The high pressure rotor thrust dummy piston is exposed to exit steam from the control stage rotating blade which over the load range is 45° to 100° cooler than nozzle exit steam. However, the opposed flow control stage has the disadvantage of being less efficient in delivering the steam to the following row of blades because of the loss associated with turning the flow 180° around the nozzle chamber to the following rows of blades. It is desirable to utilize the efficiency of the straight through flow control stage and at the same time bathe the rotor in steam significantly cooler than inlet nozzle exit steam.

U.S. Pat. No. 4,150,917 shows rotor cooling for single and double axial flow steam turbines which utilizes motive steam taken from the motive steam flow path before and after the control stage or first row of rotating blades.

The invention hereinafter described through the unique arrangement of turbine internal parts and features provides the efficiency advantage of straight through flow control stage and a significantly cooler steam supply bathing the rotor in the critical area of the nozzle chamber and thrust dummy balance piston. In addition the nozzle exit leakage steam quantity at the base seal is significantly reduced further increasing control stage efficiency.

SUMMARY OF THE INVENTION

In general a steam turbine when made in accordance with this invention comprises an outer cylinder; an inner cylinder disposed within the outer cylinder; a blade ring disposed partially within the inner cylinder and partially within the outer cylinder; a nozzle chamber assembly disposed within the inner cylinder for introducing and isolating inlet steam to the turbine and having a nozzle chamber and nozzle block portion; a rotor having a plurality of circular arrays of rotatable blades and a dummy thrust balance piston disposed thereon; and a thrust dummy ring disposed within one end of the inner cylinder. Labyrinth seals are disposed between the dummy ring and the dummy thrust balance piston forming a rotating seal therebetween. Stationary seals which provide metal to metal contact are disposed between the nozzle block and the blade ring and labyrinth seals are disposed between the I.D. of the nozzle chamber assembly and the rotor. The inner cylinder, nozzle chamber, nozzle block, blade ring, dummy ring and rotor and the seals cooperate to form an enclosed sealed chamber which confines the steam which acts on the dummy piston and a number of ports are disposed circumferentially in the blade ring with fluid communication to the sealed chamber and the ports are located downstream of the first circular array of rotating blades to provide cooled steam to the thrust dummy piston chamber.

BRIEF DESCRIPTION OF THE DRAWINGS

The objects and advantages of this invention will become more apparent from reading the following detailed description in conjunction with the accompanying drawings, in which.

DESCRIPTION OF THE PREFERRED EMBODIMENT

Figure 1:
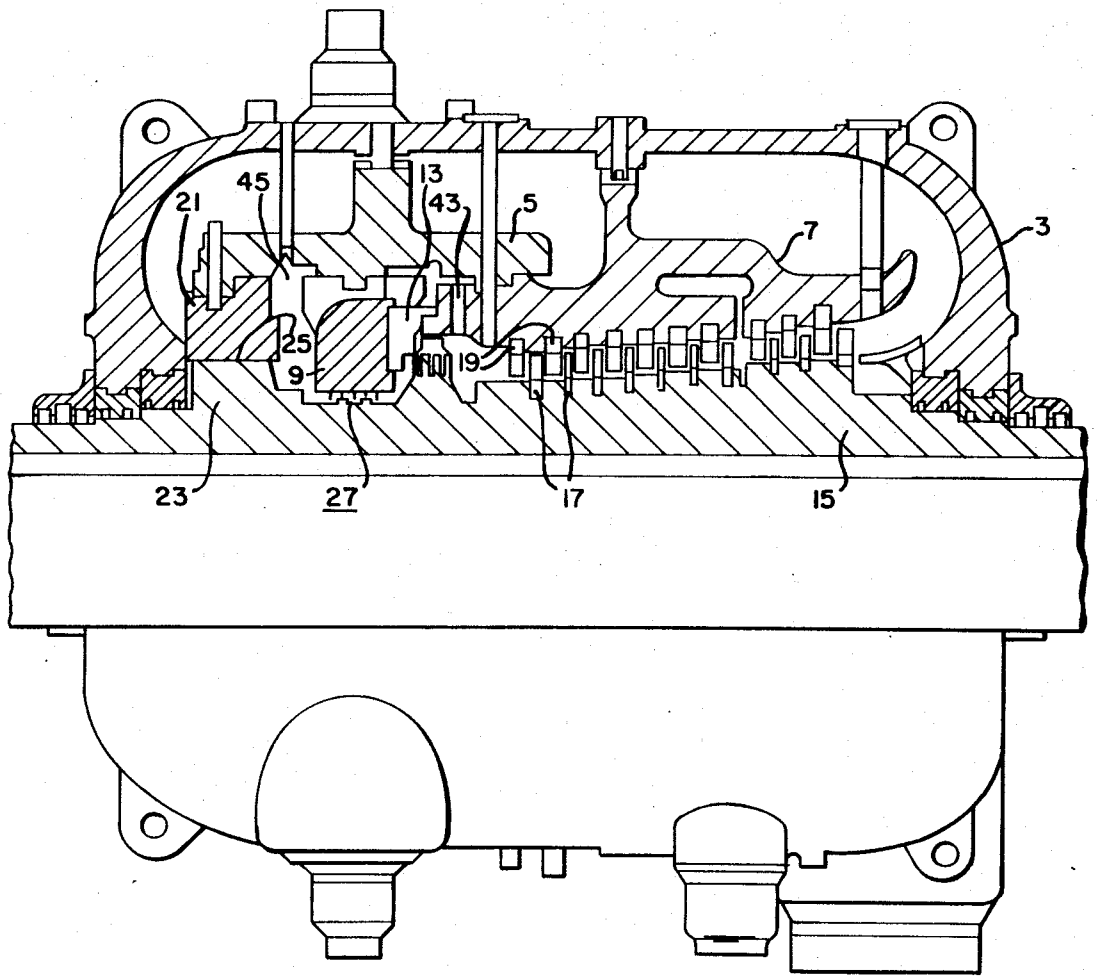
FIG. 1 is an elevational view partially in section of a steam turbine designed in accordance with this invention.
Figure 2:
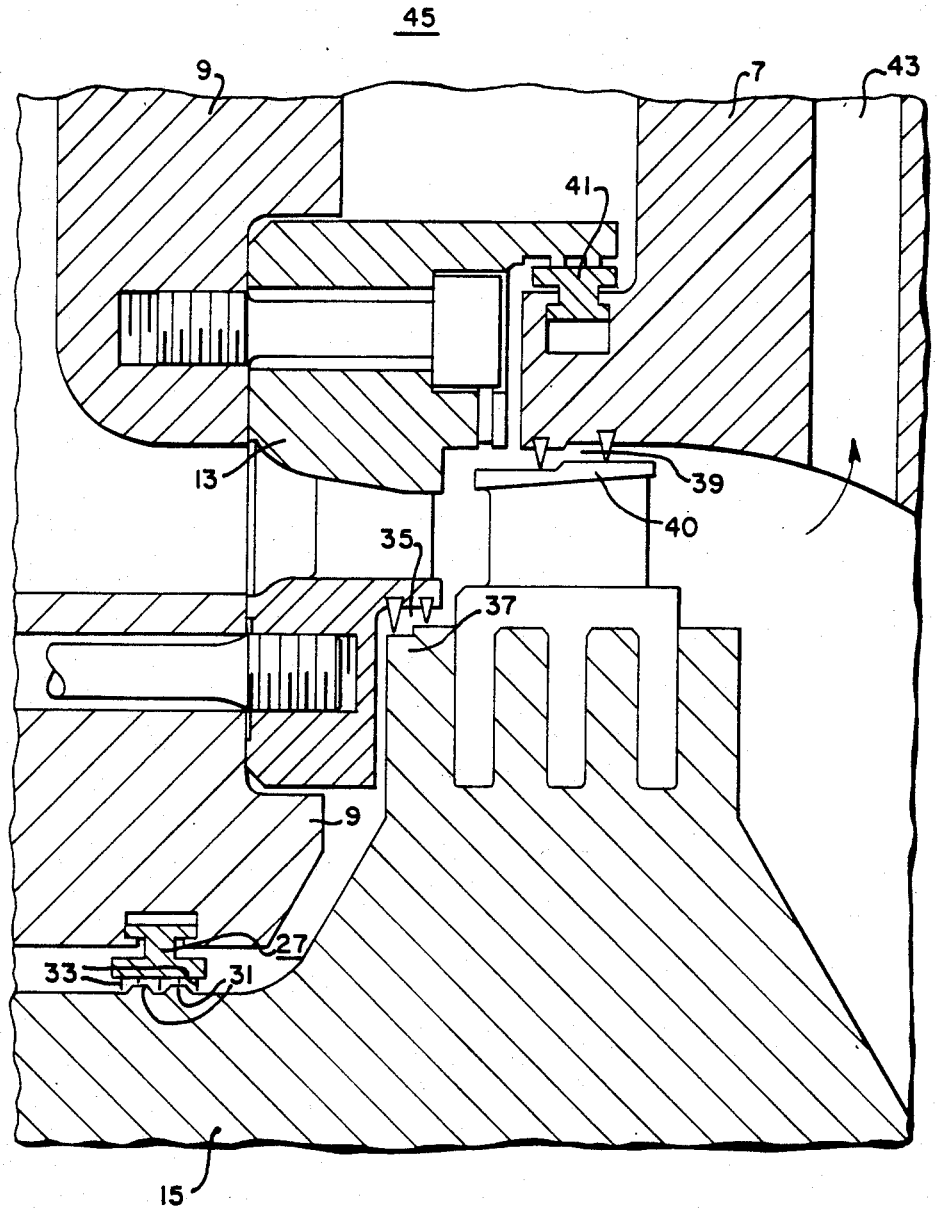
FIG. 2 is an enlarged sectional view of a portion of the turbine shown in FIG. 1.

Referring now to the drawings in detail there is shown a steam turbine 1 comprising an outer casing or cylinder 3, an inner casing or cylinder 5 disposed within the outer cylinder 3, a blade ring 7 disposed partially within the inner cylinder 5 and partially within the outer cylinder 3. A nozzle chamber assembly 9 is disposed within the inner cylinder 5 and has nozzle chamber and nozzle block portions 9 and 13, respectively. A rotor 15 is rotatably disposed in the turbine and has a plurality of circular arrays of rotatable blades or rotatable blade rows 17 disposed in series. Interdigitated with the array of rotatable blades 17 are circular arrays of stationary or nozzle blade rows 19 mounted within the blade ring 7. Disposed on one end of the inner cylinder 5 is a dummy ring 21. A thrust balance piston 23 is disposed on the rotor 15 adjacent the dummy ring 21.

A labyrinth seal 25 is disposed between the dummy ring 21 and the thrust balance piston 23 and comprises a plurality of circumferential rings serially disposed on the balance piston and a plurality of fins extending radially inwardly from the dummy ring. The fins interdigitate with the circumferential rings and are also disposed radially adjacent the center portion of the circumferential rotor rings and cooperate therewith to form a high pressure running seal between the dummy ring and the thrust balance piston.

A similar labyrinth seal 27 is disposed between the nozzle chamber 9 and rotor 15 and comprises a plurality of circumferential rings 31 serially disposed on the outer periphery of the rotor 15 and a plurality of fins 33 disposed to extend radially inwardly from the radially inner surface of the nozzle chamber 9. The fins 33 interdigitate with the rings 31 and are disposed radially adjacent the center portion of the rings 31 cooperating therewith to form a high pressure running seal between the nozzle chamber 9 and the rotor 15.

A labyrinth seal 35 is also disposed between the nozzle block 13 and the blade disc 37 on the rotor 15 adjacent the first blade row or first circular array of rotating blades to form a running pressure seal between the nozzle block 13 and the blade disc 37. A labyrinth seal 39 is also disposed between the blade ring 7 and a shroud ring 40 disposed on the outer periphery of the first row or circular array of rotating blades to restrict the flow of motive steam from bypassing the first row of blades.

A pressure tight stationary seal 41 is disposed between the nozzle block 13 and the blade ring 7 to prevent steam from leaking therebetween.

A series of ports 43 are disposed circumferentially in the blade ring 7 immediately downstream the first row of rotatable blades allowing steam which has passed through the first row of rotatable blades to pass into and fill a chamber 45 bounded by the inner cylinder 5, the blade ring 7, the nozzle chamber assembly 9, the dummy ring 21, the thrust balance piston 23 and the rotor 15 resulting in a pressure zone wherein the temperature is substantially reduced in chamber 45 therein providing the efficiency advantage of a straight through flow control stage and a significantly cooler steam supply to the rotor thrust balance piston 23 without substantially reducing the pressure on the thrust balance piston and reducing the amount of leakage steam bypassing the first row of rotating blades increasing control stage efficiency.

What is claimed is:

1. A steam turbine comprising:

an outer cylinder;

an inner cylinder disposed within the outer cylinder;

a blade ring disposed partially within the inner cylinder and partially within the outer cylinder;

a nozzle chamber assembly disposed within the inner cylinder for introducing motive steam to the turbine and having nozzle chamber and nozzle block portions;

a rotor having a plurality of circular array of rotatable blades and a thrust balance piston disposed thereon;

a dummy ring disposed within one end of the inner cylinder adjacent the balance piston;

labyrinth sealing means disposed between the dummy ring and the balance piston forming a rotating seal therebetween;

stationary sealing means disposed between the nozzle block and the blade ring;

labyrinth sealing means disposed between the nozzle chamber assembly and the rotor forming a rotatable seal therebetween;

the inner cylinder, nozzle chamber, nozzle block, blade ring, dummy ring and rotor and sealing means cooperating to form an enclosed seal chamber which confines the steam acting on the balance piston; and a port disposed in the blade ring, the port being in fluid communication with the sealed chamber and located immediately down stream of the first circular array of rotatable blades to provide a more efficient and reliable turbine.

2. A steam turbine as set forth in claim 1, wherein the labyrinth sealing means between the nozzle chamber assembly and the rotor comprises a first labyrinth seal between the nozzle block and the rotor disposed adjacent the upstream side of the first circular array of rotatable blades and a second labyrinth seal disposed between the nozzle chamber and the rotor.

3. A steam turbine as set forth in claim 2 wherein the second labyrinth seal between the nozzle chamber and the rotor comprises a plurality of circumferential rings serially disposed on the rotor cooperatively associated with a plurality of circular fins which interdigitate with the rings and are disposed radially adjacent the center portions of the rings to form a high pressure low leakage labyrinth seal.

4. A steam turbine as set forth in claim 1 wherein the circular arrays of rotatable blades are disposed in series along the rotor and the steam flows generally in one direction through said circular arrays.

* * * * *